US009553427B2

(12) United States Patent
Achtstätter et al.

(10) Patent No.: US 9,553,427 B2
(45) Date of Patent: Jan. 24, 2017

(54) CORONA IGNITION DEVICE

(71) Applicant: BorgWarner BERU Systems GmbH, Ludwigsburg (DE)

(72) Inventors: Tom Achtstätter, Hemmingen (DE); Timo Stifel, Korntal-Münchingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 214 days.

(21) Appl. No.: 14/081,029

(22) Filed: Nov. 15, 2013

(65) Prior Publication Data

US 2014/0137845 A1 May 22, 2014

(30) Foreign Application Priority Data

Nov. 20, 2012 (DE) ..... 10 2012 111 172

(51) Int. Cl.

| | |
|---|---|
| ***H01T 19/04*** | (2006.01) |
| ***H01T 19/00*** | (2006.01) |
| ***H01T 13/44*** | (2006.01) |
| ***H01T 13/34*** | (2006.01) |
| ***H01T 13/50*** | (2006.01) |
| *H01T 19/02* | (2006.01) |
| *H01T 13/05* | (2006.01) |

(52) U.S. Cl.

CPC ..... *H01T 13/44* (2013.01); *H01T 13/34* (2013.01); *H01T 13/50* (2013.01); *H01T 19/00* (2013.01); *H01T 19/04* (2013.01); *H01T 13/05* (2013.01); *H01T 19/02* (2013.01)

(58) Field of Classification Search

CPC ..... H01T 13/44; H01T 13/34; H01T 13/05; H01T 19/00; H01T 19/02; H01T 19/04; H01T 13/50; F02P 23/04

See application file for complete search history.

(56) References Cited

U.S. PATENT DOCUMENTS

| | | | | |
|---|---|---|---|---|
| 3,229,032 | A * | 1/1966 | Willis | 174/152 S |
| 7,777,401 | B2 | 8/2010 | Jaffrezic et al. | |
| 7,963,262 | B2 | 6/2011 | Heise | |
| 2008/0024258 | A1* | 1/2008 | Nakao | H01F 38/12 336/107 |
| 2010/0175653 | A1* | 7/2010 | Lykowski et al. | 123/143 C |
| 2011/0253089 | A1 | 10/2011 | Braeuchle et al. | |

FOREIGN PATENT DOCUMENTS

DE 10 2010 055 570 B3 3/2012

* cited by examiner

*Primary Examiner* — Jacob Amick

(74) *Attorney, Agent, or Firm* — Bose McKinney & Evans LLP

(57) ABSTRACT

The invention relates to a corona ignition device for igniting fuel in an internal combustion engine by means of a corona discharge, comprising a central electrode, an insulator, into which the central electrode plugs, a housing, into which the insulator plugs, a bobbin, onto which a coil which is attached to the central electrode is wound, and a shield cap, which is plugged onto an end portion of the bobbin facing the insulator. According to the invention, a portion of the central electrode protrudes through a bottom of the shield cap, or a circumferential wall of the shield cap has one or more slots, or the shield cap has a circumferential wall, which protrudes only on one side beyond the bottom of the shield cap only on one side.

20 Claims, 4 Drawing Sheets

CORONA IGNITION DEVICE

RELATED APPLICATIONS

This application claims priority to DE 10 2012 111 172.3, filed Nov. 20, 2012, the entire disclosure of which is hereby incorporated herein by reference in its entirety.

BACKGROUND

The present invention is based on a corona ignition device for igniting fuel in an internal combustion engine by means of a corona discharge. Such a corona ignition device is known from DE 10 2010 055 570 B3.

A problem of corona ignition devices is insufficient dielectric strength. Dielectric breakdown and partial discharges often lead in known corona ignition devices to premature failure. The risk of dielectric breakdown can be considerably reduced by plugging a shield cap onto an end portion of a bobbin facing the insulator of the corona ignition device.

The shield cap of the corona ignition device known from DE 10 2010 055 570 B3 has an H-shaped cross section. The shield cap is plugged on one side onto the end portion of the bobbin and on the other side onto an end portion of the insulator. The coil is electrically connected to the coil via the bottom of the shield cap. This connection can be achieved by a contact sleeve that is arranged on the bottom of the shield cap and facilitates an electrical plug-in connection for connection of the coil.

SUMMARY

The present disclosure provides a simplified manufacture of a corona ignition device for igniting fuel in an internal combustion engine by means of a corona discharge.

In a corona ignition device according to this disclosure, a portion of the central electrode protrudes through the bottom of the shield cap. A pin is thus provided in the interior of the shield cap and enables a simple connection of the coil to the central electrode. For example, the bobbin may carry a socket, which is plugged onto said central electrode portion.

The shield cap can be a single piece including a pin forming a portion of the central electrode. It is also possible for the shield cap to be joined to the pin forming a portion of the central electrode. For example, the shield cap can be pressed onto the pin or screwed onto it. It is also possible for the shield cap to be welded to the pin. In this case, it is important that the weld seam connecting the shield cap to the pin is arranged completely inside the shield cap. Otherwise, the weld seam will be a protrusion that may cause local increases in the strength of the electric field and thus dielectric breakdown. This can be avoided if the weld seam is arranged completely in the shield cap, that is to say that during welding the pin and shield cap are only acted on from the inside of the shield cap.

In order to weld the shield cap to the pin, different welding techniques can be used, for example laser welding, friction welding or resistance welding. Laser welding is preferred, since in this way, when welding, a joint between the pin and shield cap can be acted on only from the inside of the shield cap without difficulty, and the weld seam is consequently located exclusively inside the shield cap.

In an advantageous refinement of this disclosure, the shield cap has a peripheral wall which projects only on one side beyond the bottom of the shield cap, through which the central electrode protrudes. Such a shield cap has a U-shaped cross section. The production of the shield cap and the assembly of the corona ignition device can thus be considerably simplified. Surprisingly, shielding results that are just as good as those achieved with a shielding cap that is H-shaped in cross section can be achieved by such a cup-shaped shield cap that is U-shaped in cross section.

The shield cap can be produced for example from copper, silver, aluminium or any other metal that is a good conductor. The shield cap can be produced solidly from a material that is a good conductor, although this is not necessarily the case. A surface coating formed from a metal that is a good conductor is sufficient. Such a coating may have a thickness of 0.1 mm or more, for example.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
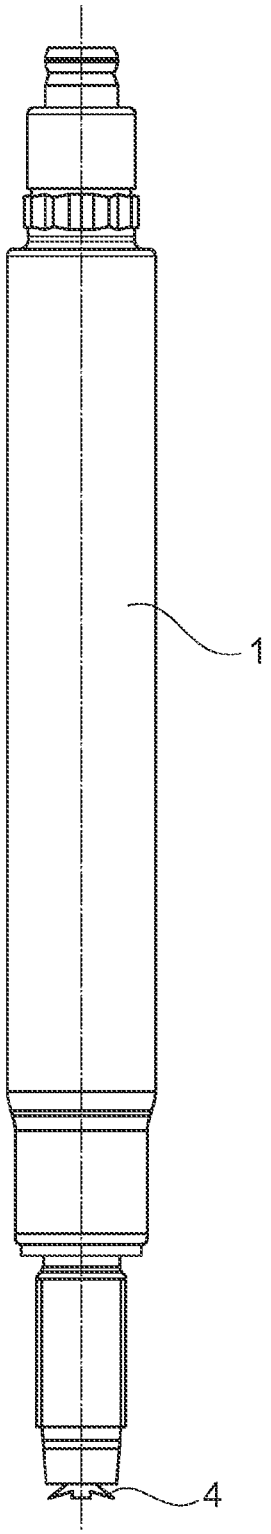
FIG. 1 shows an embodiment of a corona ignition device.
Figure 2:
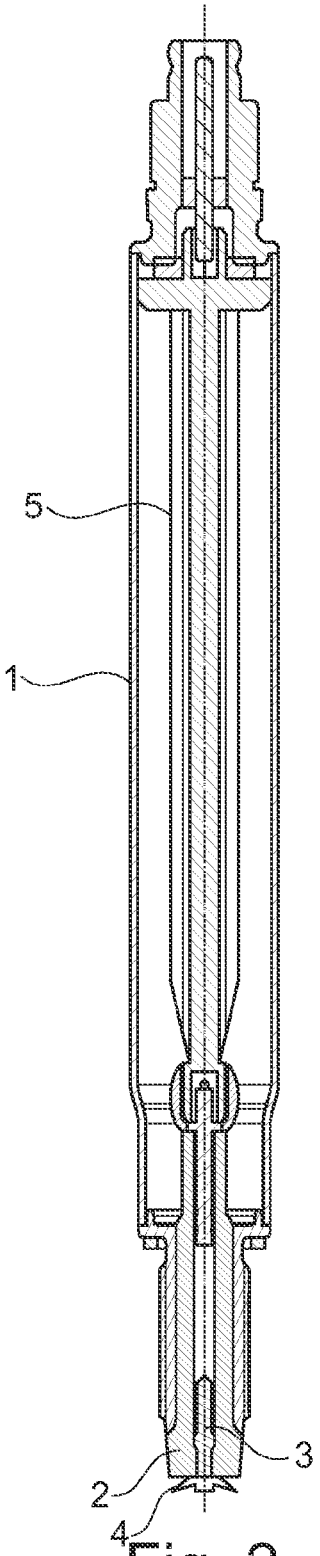
FIG. 2 shows a sectional view of FIG. 1.

The corona ignition device illustrated in FIG. 1 has a housing 1, which is closed at one end by an insulator 2. As is shown in particular in FIG. 2, a central electrode 3 protrudes from the insulator 2 and leads to at least one ignition tip. Since an ignition head 4 having a plurality of ignition tips is fixed to the central electrode, a corona discharge can be generated in a larger volume.

The central electrode 3, the insulator 2, and the housing 1 together form a capacitor which is connected in series to a coil 5 attached to the central electrode 3. This capacitor and the coil 5 arranged in the housing 1 form an electric resonating circuit. By excitation of this resonating circuit corona discharges can be created at the ignition tip or the ignition tips.

An end portion of the housing 1 surrounding the insulator 2 may have an outer thread for screwing into an engine block. Instead of an outer thread, the corona ignition device may also be secured by other means to an engine block.

The central electrode 3 can be composed of a plurality of parts, for example pins, which protrude at different ends from the insulator 2 and are connected inside the insulator by a glass seal, i.e. glass that has been molten inside the insulator. The glass is a conductive glass, that is to say glass that has been made electrically conductive by electrically conductive additives, such as graphite particles or metal particles. The glass seals the channel leading through the insulator 2. The central electrode 3 or pins belonging to the central electrode sit in said channel.

Figure 3:
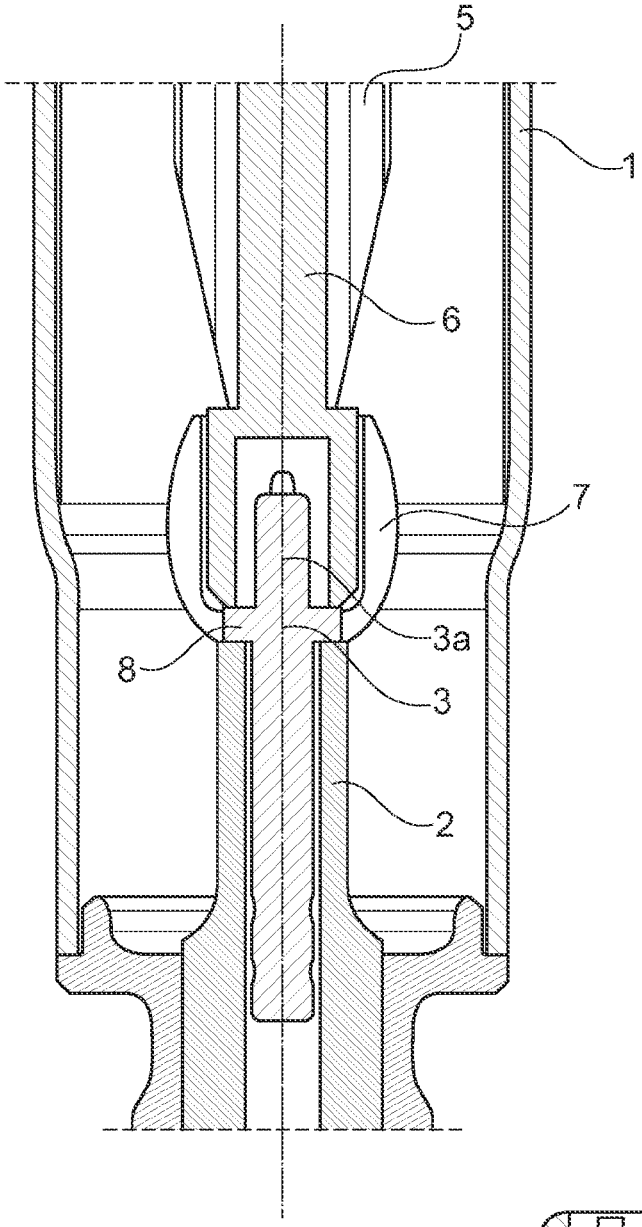
FIG. 3 shows a detailed view of FIG. 2.

As is shown in particular in FIG. 3, the coil 5 is wound onto a bobbin 6. A shield cap 7 is plugged onto an end portion of the bobbin 6. The shield cap 7 has a U-shaped cross section with rounded outer contours. The shield cap 7 thus has a circumferential wall which surrounds the end portion of the bobbin 6 and projects beyond the bottom of the shield cap 7 only on one side, specifically on the side facing the bobbin 6. The shield cap 7 is preferably made of metal, but for example can also be made of electrically conductive ceramic, electrically conductive plastic and/or metal-coated plastic or metal-coated ceramic.

A portion 3*a* of the central electrode 3 protrudes through a bottom of the shield cap 7. The end portion of the bobbin 6 is plugged onto said portion 3*a*, and the coil 5 is thus attached to the central electrode 3. The bobbin 6 may for this purpose carry a socket or form a socket, as is illustrated in FIG. 3. This socket has a hole that is filled by the central electrode 3. Portion 3*a* of the central electrode 3 protrudes through the bottom of the shield cap.

The shield cap 7 and a pin 3*a*, which forms a portion of the central electrode 3, can together be manufactured as a single piece. The shield cap 7 is preferably joined to a pin, however, which forms a portion of the central electrode 3. For example, the shield cap 7 can be pressed or shrunk-fit onto such a pin. A further possibility lies in welding the pin to the shield cap 7. In this case, the shield cap 7 should be welded to the pin by means of a weld seam that is arranged completely inside the shield cap 7.

Figure 4:
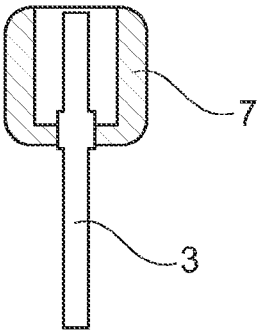
FIG. 4 shows a schematic detailed view of a further embodiment.
Figure 5:
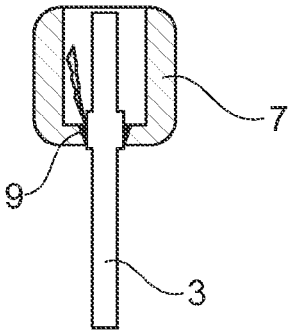
FIG. 5 shows a schematic detailed view of a further embodiment.

FIG. 4 schematically shows a shield cap 7 which is pressed onto a pin. FIG. 5 schematically shows a shield cap 7 which is welded to a pin, wherein the weld seam 9 connecting the pin to the shield cap 7 is arranged completely in the shield cap 7. During the welding process, the shield cap 7 is thus acted on exclusively from the inside.

In the embodiment of FIG. 3, the pin has an annular shoulder, by means of which it sits on the insulator 2. This annular shoulder can be formed for example by a sealing collar 8, which forms the bottom or part of the bottom of the shield cap 7. The sealing collar 8 is arranged between the insulator 2 and the bobbin 6. The sealing collar 8 or the annular shoulder of the pin can, for example, prevent an escape of liquid glass when the glass is molten inside the insulator 2.

Figure 6:
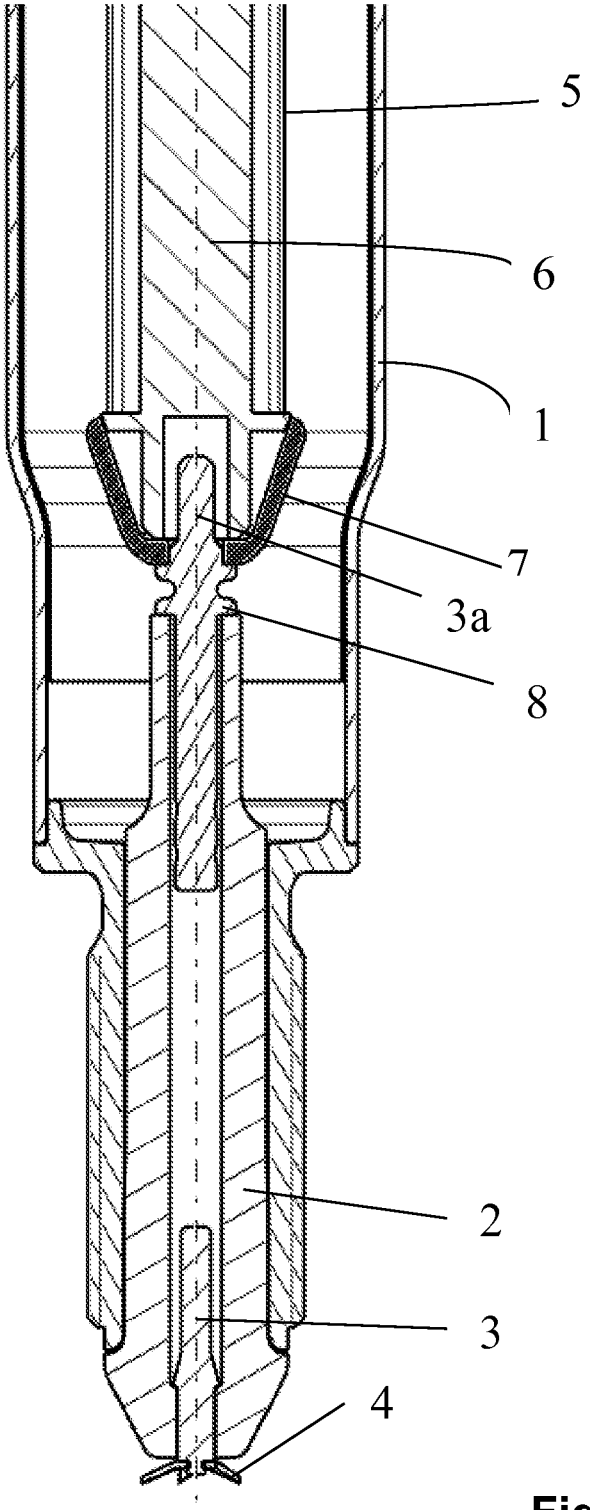
FIG. 6 shows a schematic detailed view of a further embodiment.

In the embodiment of FIG. 6, the shield cap 7 has a slightly different shape compared to the embodiment of FIG. 3. In the embodiment of FIG. 3, the circumferential wall of the shield cap has a convex curvature on its outer side. In the embodiment of FIG. 6, the circumferential wall of the U-shaped shield cap 7 by contrast is planar over the majority of its length and is rounded only at its end facing the coil 5. A further difference from the embodiment of FIG. 3 is that the bobbin 6 does not taper towards the shield cap 7. The bobbin 6 may have a flange that terminates flush with the shield cap 7.

The shield cap in FIG. 6 can also be used with a tapering bobbin.

A further difference between the embodiments of FIGS. 3 and 6 also lies in the embodiment of the central electrode. In FIG. 6, the portion 3*a* of the central electrode projecting into the shield cap 7 adjoins a flange that bears against a bottom of the shield cap 7. The central electrode may have a second flange 8, which bears against the insulator 2. These two flanges can be combined to form a single flange, which then bears on one side against the shield cap 7 and on the other side against the insulator 2.

Figure 7:
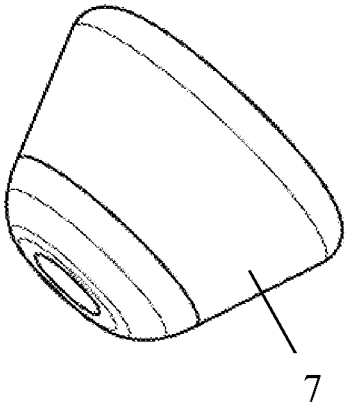
FIG. 7 shows an embodiment of the shield cap of the embodiment of FIG. 6.
Figure 8:
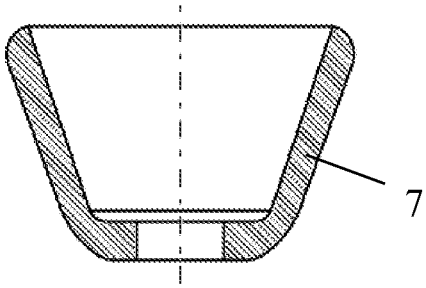
FIG. 8 shows a further view of FIG. 7.
Figure 9:
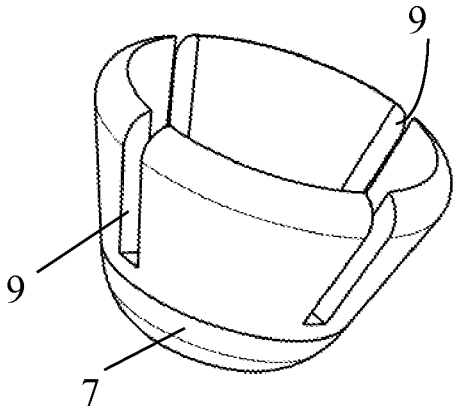
FIG. 9 shows a further embodiment of the shield cap of the embodiment of FIG. 6.
Figure 10:
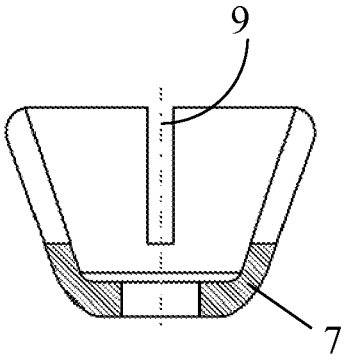
FIG. 10 shows a further view of FIG. 9.

FIGS. 7 and 8 show the shield cap 7 of the embodiment of FIG. 6. FIGS. 8 and 9 show a further embodiment of the shield cap of the embodiment of FIG. 6. In this embodiment, the circumferential wall of the shield cap is provided with a plurality of slots 9. The slots each start from an edge of the circumferential wall. The slots 9 cause a reduction of eddy losses. In the embodiment shown, the slots are open towards the coil.

The number of slots can be selected in a wide range. In the embodiment shown, four slots 9 are provided. The shield cap 7 can also be provided just one, two, three, or more than four slots 9. For example, two to eight slots may be provided.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A corona ignition device for igniting fuel in an internal combustion engine by means of a corona discharge, comprising:

a central electrode;

an insulator from which the central electrode protrudes;

a housing which is closed at one end by the insulator, a bobbin onto which a coil is wound which is electrically connected to the central electrode;

a shield cap enclosed by the housing, an end portion of the bobbin being inserted into the shield cap, said end portion facing the insulator; and wherein a portion of the central electrode protrudes through a bottom of the shield cap and wherein the shield cap is an electrical conductor and is at least partially formed from metal.

2. The corona ignition device according to claim 1, wherein the bobbin carries a socket into which the portion of the central electrode that protrudes through the bottom of the shield cap is inserted.

3. The corona ignition device according to claim 1, wherein the shield cap is formed in one piece together with a pin which forms a portion of the central electrode.

4. The corona ignition device according to claim 1, wherein the shield cap is connected to a pin that protrudes through a bottom of the shield cap and forms a portion of the central electrode.

5. The corona ignition device according to claim 4, wherein the shield cap is pressed onto the pin.

6. The corona ignition device according to claim 4, wherein the shield cap is welded to the pin by a weld seam that is arranged completely inside the shield cap.

7. The corona ignition device according to claim 3, wherein the pin has an annular shoulder by means of which it sits on the insulator.

8. The corona ignition device according to claim 3, wherein the pin has a sealing collar, which is arranged between the insulator and the bobbin.

9. The corona ignition device according to claim 3, wherein a glass seal is arranged in the insulator, said glass seal connecting the pin to the insulator.

10. The corona ignition device according to claim 1, wherein the shield cap has a circumferential wall, which protrudes only on one side beyond the bottom of the shield cap.

11. The corona ignition device according to claim 1, wherein the shield cap has one or more slots.

12. A corona ignition device for igniting fuel in an internal combustion engine by means of a corona discharge, comprising:

a central electrode;

an insulator from which the central electrode protrudes;

a housing which is closed at one end by the insulator;

a bobbin onto which a coil is wound which is electrically connected to the central electrode; and a shield cap, into which an end portion of the bobbin is inserted, said end portion facing the insulator;

wherein the coil extends along the longitudinal axis of the bobbin farther than the shield cap in a direction away from the insulator, and wherein a circumferential wall of the shield cap has one or more slots extending through the circumferential wall.

13. A corona ignition device for igniting fuel in an internal combustion engine by means of a corona discharge, comprising:

a central electrode;

an insulator from which the central electrode protrudes;

a housing which is closed at one end by the insulator;

a bobbin onto which a coil is wound which is electrically connected to the central electrode; and a shield cap into which an end portion of the bobbin is inserted, said end portion facing the insulator, the turns of the coil beginning above and extending away from the shield cap;

wherein the shield cap has a circumferential wall, which protrudes only on one side beyond a bottom of the shield cap and wherein the shield cap includes a metal electrical conductor.

14. The corona ignition device according to claim 13, wherein the shield cap has a surface coating of the metal electrical conductor.

15. The corona ignition device according to claim 12, wherein at least part of the coil is uncovered by the shield cap.

16. The corona ignition device according to claim 12, wherein the shield cap is an electrical conductor.

17. The corona ignition device according to claim 12, wherein the shield cap includes a metal.

18. The corona ignition device according to claim 1, wherein the shield cap includes a metal.

19. The corona ignition device according to claim 18, wherein the shield cap has a surface coating of the metal.

20. The corona ignition device according to claim 1, wherein at least part of the coil is uncovered by the shield cap.

* * * * *